US008166949B2

(12) United States Patent
Hicks et al.

(10) Patent No.: US 8,166,949 B2
(45) Date of Patent: May 1, 2012

(54) CYLINDER HEAD DRY VALLEY DRAIN

(75) Inventors: James B. Hicks, Shelby Township, MI (US); Curt R. Danielewicz, Macomb, MI (US); Gary L. Nye, Macomb, MI (US); Manmeet S. Pannu, Sterling Heights, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 12/912,852

(22) Filed: Oct. 27, 2010

(65) Prior Publication Data

US 2011/0277724 A1 Nov. 17, 2011

Related U.S. Application Data

(60) Provisional application No. 61/345,397, filed on May 17, 2010.

(51) Int. Cl.
*F02F 1/36* (2006.01)

(52) U.S. Cl. ..... 123/193.5; 123/195 C

(58) Field of Classification Search ..... 123/193.5, 123/193.1, 195 C, 198 R, 19
See application file for complete search history.

(56) References Cited

U.S. PATENT DOCUMENTS

| | | | | |
|---|---|---|---|---|
| 4,131,101 | A | 12/1978 | DeVinney | |
| 5,081,960 | A * | 1/1992 | Shimamoto | 123/41.82 R |
| 5,651,344 | A * | 7/1997 | Nishigaki et al. | 123/432 |
| 5,799,631 | A * | 9/1998 | Nakamura | 123/90.17 |
| 2003/0154948 | A1 * | 8/2003 | Hattori | 123/195 R |

* cited by examiner

*Primary Examiner* — M. McMahon
(74) *Attorney, Agent, or Firm* — Quinn Law Group, PLLC

(57) ABSTRACT

An engine comprises a cylinder head at least partially defining a dry valley and a cover secured to the cylinder head. The cover defines a first aperture. A boss extends from the cylinder head toward the cover. The boss defines a second aperture. A fastener extends through the first aperture and at least partially through the second aperture to secure the cover to the cylinder head. The fastener defines a passage to fluidly connect the dry valley to an exterior of the engine.

13 Claims, 3 Drawing Sheets

CYLINDER HEAD DRY VALLEY DRAIN

CROSS REFERENCE TO RELATED APPLICATIONS

This application claims the benefit of U.S. Provisional Application Ser. No. 61/345,397 filed May 17, 2010, the entire contents of which are hereby incorporated by reference.

TECHNICAL FIELD

The invention relates to a cylinder head for an engine, and specifically to an arrangement for draining a dry valley of a cylinder head.

BACKGROUND

A vehicle engine typically includes a cylinder head secured to an engine block to form an engine housing. The cylinder head is commonly formed to follow the shape of the internal components, while maintaining a sufficient thickness for engine operation. Due to varying shapes of the engine component a dry valley may be formed by the cylinder head. A dry valley is a depression formed on the exterior of the cylinder head and sealed from the internal components of the engine. Dry valleys may collect fluids from the external environment, such as road splash, from vehicle washing, etc. In order to maintain engine life the fluids should be drained from the dry valley.

SUMMARY

An engine comprises a cylinder head at least partially defining a dry valley and a cover secured to the cylinder head. The cover defines a first aperture. A boss extends from the cylinder head toward the cover. The boss defines a second aperture. A fastener extends through the first aperture and at least partially through the second aperture to secure the cover to the cylinder head. The fastener defines a passage to fluidly connect the dry valley to an exterior of the engine.

An engine assembly comprises a cylinder head secured to an engine block. The cylinder head at least partially defines a dry valley to allow access to a plurality of components that are generally located in the cylinder head along an axis for the engine. A cover has at least a portion that is spaced apart from the cylinder head to at least partially define a gap therebetween. The cover also defines a first aperture for attaching the cover to the cylinder head. A boss extends from the cylinder head through the gap toward the cover. The boss defines a second aperture for attaching the cover to the cylinder head. A fastener extends through the first aperture and at least partially through the second aperture to attach the cover to the cylinder head. The fastener defines a through passage extending along a generally central axis of the fastener to fluidly connect the dry valley to an exterior of the engine.

The above features and advantages and other features and advantages of the present invention are readily apparent from the following detailed description of the best modes for carrying out the invention when taken in connection with the accompanying drawings.

DETAILED DESCRIPTION

Figure 1:
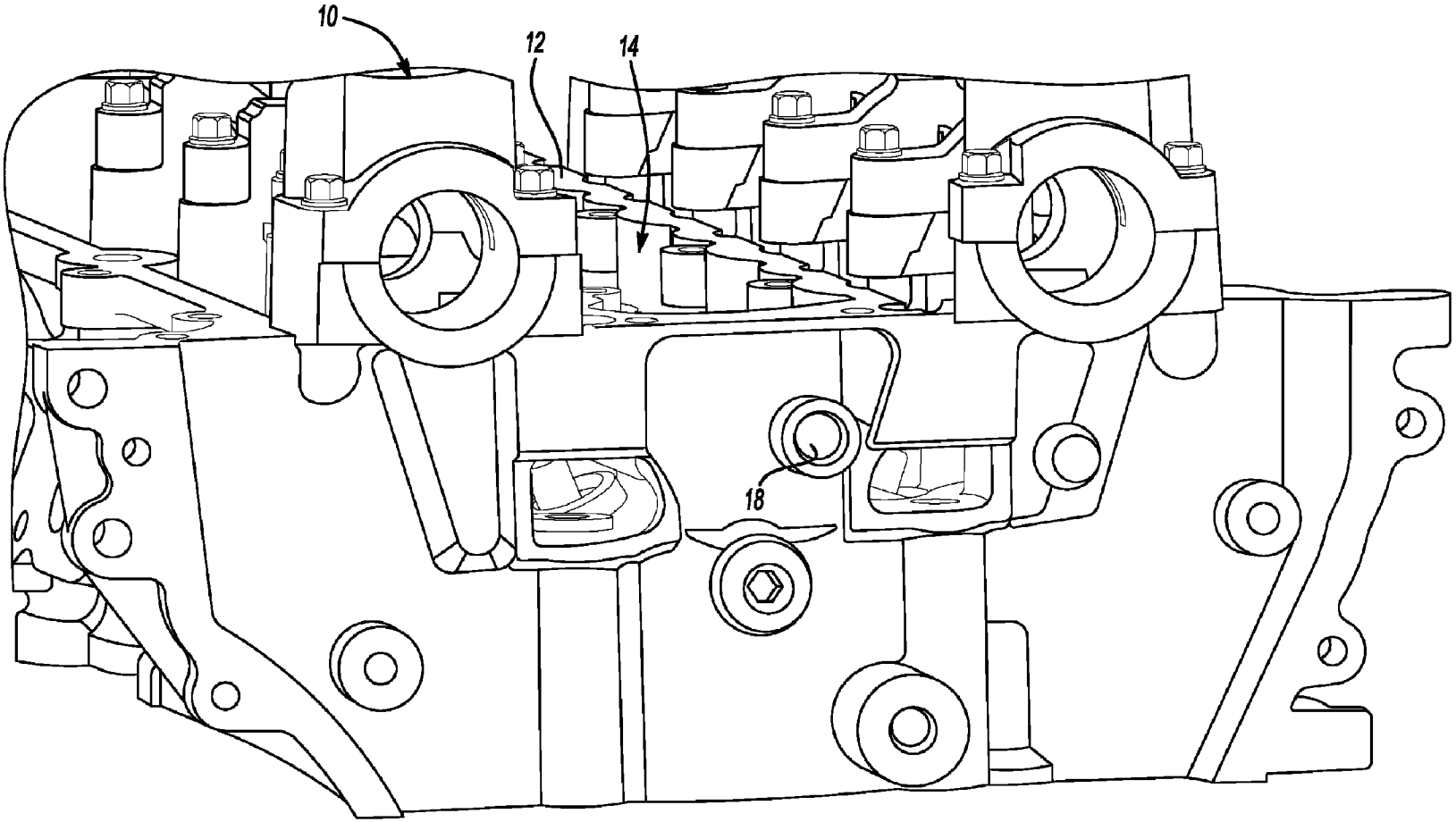
FIG. 1 is a partial schematic perspective view of a cylinder head for an engine.
Figure 2:
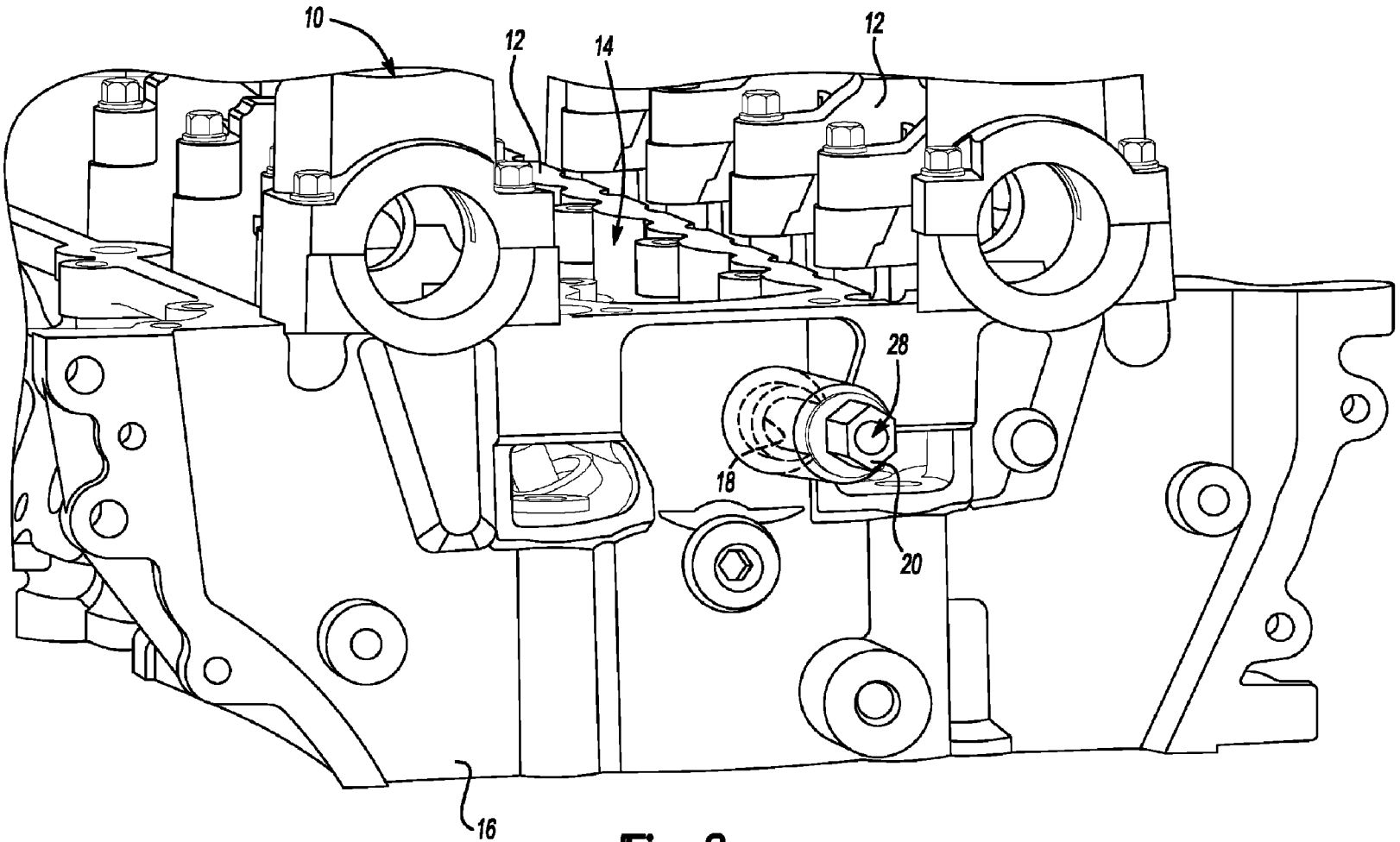
FIG. 2 is a partial schematic perspective view of the cylinder head of FIG. 1 illustrating a drain passage.

Referring to the drawings wherein like reference numbers refer to like components, FIGS. 1 and 2 illustrate an engine 10 having a cylinder head 12. The cylinder head 12 at least partially defines a dry valley 14. In the embodiment shown in FIG. 1, the dry valley 14 is located generally along a central axis of the cylinder head 12 and allows for access to various engine 10 components (not numbered) such as the injectors and spark plugs. A front cover 16 (shown in FIG. 2) is secured to the cylinder head 12. A first aperture 18 is defined by the cover 16. A fastener 20 (shown in FIGS. 2 and 3) may pass through the first aperture 18 to secure the cover 16 to the cylinder head 12 to reduce movement and vibration of the cover 16 relative to the cylinder head 12.

Figure 3:
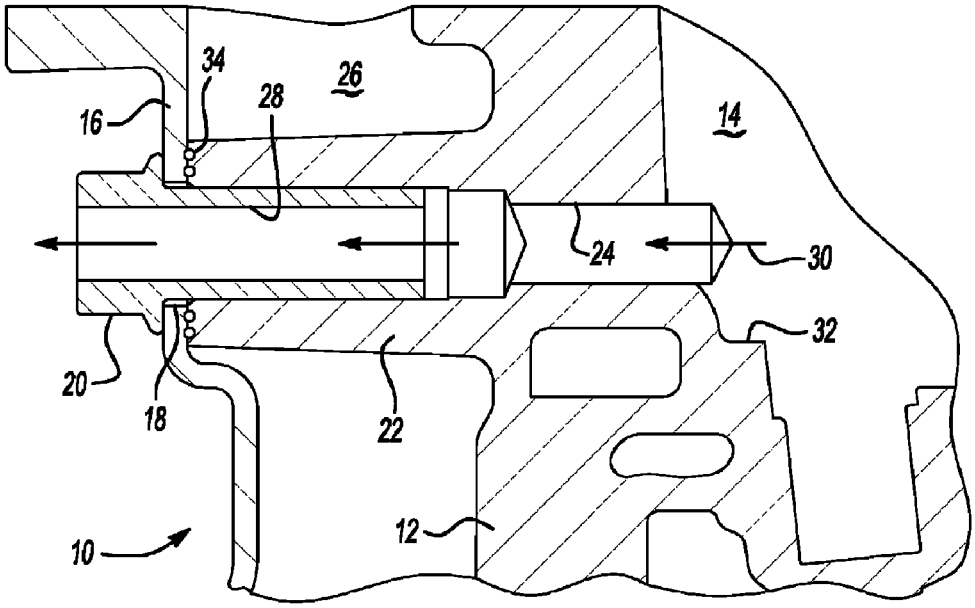
FIG. 3 is a partial schematic cross-sectional view of the cylinder head and drain passage of FIGS. 1-2.

Referring to FIGS. 2 and 3, a boss 22 (shown in FIG. 3) extends from the cylinder head 12 through a gap 26 at least partially defined by the cylinder head 12 and the cover 16. The gap 26 is located internally within the engine 10. In the embodiment shown, the gap 26 houses the timing chain and various other components and is commonly referred to as a timing chain case. The fastener 20 secures the cover 16 to the cylinder head 12 such that a passage is formed by the first aperture 18 in the cover 16 and the second aperture 24 in the cylinder head. In the embodiment shown, the fastener 20 is a bolt which passes through the first aperture 18 and is threaded into the second aperture 24. The fastener 20 further defines a passage 28. The passage 28 is formed along the central axis of the fastener 20 and fluidly connects the dry valley 14 to the exterior of the engine 10. Thus, fluid captured in the dry valley 14 may drain through the passage 28 in the fastener 20. Fluid flow is generally indicated by arrows 30 in FIG. 3. The boss 22, fastener 20 and passage 28 cooperate together to allow fluid within the dry valley 14 to drain to the exterior of the engine 10 while being fluidly separated from the gap 26 and the interior of the engine 10. Sealant 34 (or a gasket) may be located between the boss 22 and the cover 16 to assist in sealing the engine 10.

The size of the boss 22 and fastener 20 may be adjusted to provide the desired size of the passage 28. That is, the size of the boss 22, fastener 20 and passage 28 may be determined based upon the desired amount of drainage from the dry valley 14. Additionally, the weight of the fastener 20 and boss 22 and the machining of the cylinder head 12 and cover 16 may also be taken into account when determine the size of the passage 28. One skilled in the art would be able to determine the appropriate size for the boss 22, fastener 20 and passage 28 for a particular engine 10.

The first aperture 18, second aperture 24 and passage 28 may be formed in a manner to assist in moving fluid from the dry valley 14 to the exterior of the engine 10. For example, when assembled the passage 28 may have a downward slope toward the exterior of the engine 10. The cylinder head 12 at least partially defines a floor 32 for the dry valley 14. The first aperture 18, second aperture 24, and passage 28 may be defined in a location as close the floor 32 of the dry valley 14 as possible to assist in draining any fluid within the dry valley 14. In fact, the second aperture 24 may be formed in the floor 32 of the valley 14 and the boss 22 may extend downward and outward towards the cover 16 and the first aperture 18. Additionally, the floor 32 of the dry valley 14 may be formed to slope toward the second aperture 24 to assist in moving fluid within the dry valley 14 toward the second aperture 24 for draining. Alternatively the first aperture 18, second aperture 24 and boss 22 may be formed in a location that fluid would naturally flow during operation of the vehicle (not shown). For example, at an outboard location on the engine 10 such that lateral forces during driving and turning the vehicle will move any fluid toward the second aperture 24.

Figure 4:
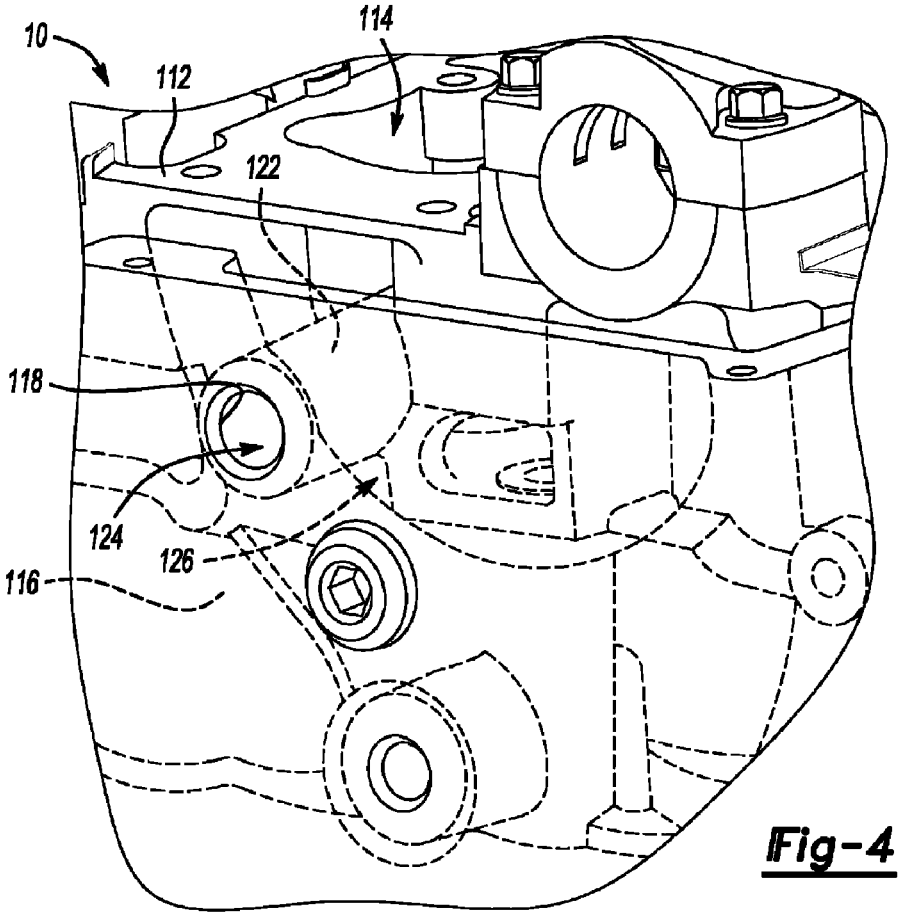
FIG. 4 is an enlarged partial schematic perspective view of another embodiment of a cylinder head for an engine.

Referring to FIG. 4, another embodiment of a cylinder head 112 having a dry valley 114 is illustrated. A cover 116 for the engine 10 is shown in phantom. Although the cylinder head 12, 112 and cover 16, 116 of FIGS. 1 and 4 have varying boss and bolt patterns, the cylinder head 12, 112 and cover 16,116 cooperate in the same manner in both embodiments. The cylinder head 112 defines a boss 122 extending toward the cover 116 and having a second aperture 124. The second aperture 124 also receives the fastener 20 (shown in FIGS. 2 and 3) to secure the cover 116 to the cylinder head 112 and to form passage 28 (shown in FIGS. 2 and 3) for draining fluid from the dry valley 114.

In the embodiments illustrated above, the boss 22, 122 extends from the cylinder head 12, 112 toward the front cover 16, 116. Alternatively, the boss 22, 122 may be formed on the cover 16, 116, and extend toward the cylinder head 12, 112 through the gap 26, 126 formed between the cylinder head 12, 112 and the cover 16, 116. The gap 26, 126 is part of the crank case and may include the timing chain (not shown) or other components. Therefore, the first aperture 18, 118, second aperture 24,124 and boss 22,122 should be formed in a location that does not interfere with the internal components (not shown) of the engine 10. One skilled in the art would be able to determined the proper location and arrangement for the first aperture 18, 118, second aperture 24, 124, boss 22, 122, and fastener 20.

Therefore, the above embodiments disclose an engine 10 having a cylinder head 12, 112 at least partially defining a dry valley 14, 114. There is a cover 16, 116 secured to the cylinder head 12, 112 defining a first aperture 18, 118. A boss 22, 122 extends from the cylinder head 12, 112 toward the cover 16, 116. The boss 22, 122 defines a second aperture 24, 124. A fastener 20 extending through the first aperture 18, 118 and the second aperture 24, 124 secures the cover 16, 116 to the cylinder head 12, 112. The fastener 20 defines a passage 28 to fluidly connect the dry valley 14, 114 to an exterior of the engine 10.

While the best modes for carrying out the invention have been described in detail, those familiar with the art to which this invention relates will recognize various alternative designs and embodiments for practicing the invention within the scope of the appended claims.

The invention claimed is:

1. An engine comprising:

a cylinder head at least partially defining a dry valley;

a cover secured to the cylinder head and defining a first aperture;

wherein the cylinder head includes a boss protruding toward the cover, and wherein the boss defines a second aperture; and a fastener extending through the first aperture and at least partially through the second aperture to secure the cover to the cylinder head, wherein the fastener defines a passage to fluidly connect the dry valley to an exterior of the engine.

2. The engine of claim 1, wherein the passage is fluidly sealed from an interior of the engine.

3. The engine of claim 2, wherein the boss defines a first sealing surface and the cover defines a second sealing surface, and wherein sealant is located between the first sealing surface of the boss and the second sealing surface of the cover.

4. The engine of claim 1, wherein the boss extends from the cylinder head through a gap at least partially defined by the cylinder head and the cover.

5. The engine of claim 3, wherein the gap is at least partially defined by the cylinder head and the cover, the cover being a portion of the engine crankcase.

6. The engine of claim 1, wherein the passage slopes downward toward an exterior of the engine.

7. The engine in claim 1, wherein the cylinder head defines a floor for the dry valley, and wherein the floor slopes toward the second aperture.

8. An engine assembly comprising:

a cylinder head secured to an engine block, wherein the cylinder head at least partially defines a dry valley to allow access to a plurality of components that are generally located in the cylinder head along an axis for the engine;

a cover having at least a portion spaced apart from the cylinder head to at least partially define a gap therebetween, and wherein the cover defines a first aperture for attaching the cover to the cylinder head;

wherein the cylinder head includes a boss protruding toward the cover, and wherein the boss defines a second aperture for attaching the cover to the cylinder head; and a fastener extending through the first aperture and at least partially through the second aperture to attach the cover to the cylinder head, wherein the fastener defines a through passage extending along a generally central axis of the fastener to fluidly connect the dry valley to an exterior of the engine.

9. The engine assembly of claim 8, wherein the passage is fluidly sealed from an interior of the engine.

10. The engine assembly of claim 9, wherein the boss defines a first sealing surface and the cover defines a second sealing surface, and wherein sealant is located between the first sealing surface of the boss and the second sealing surface of the cover.

11. The engine assembly of claim 10, wherein the gap is at least partially defined by the cylinder head and the cover, the cover being a portion of the engine crankcase.

12. The engine assembly of claim 8, wherein the passage slopes downward toward an exterior of the engine.

13. The engine assembly in claim 8, wherein the cylinder head defines a floor for the dry valley, and wherein the floor slopes toward the second aperture.

* * * * *